US008089443B2

(12) United States Patent
Tanaka

(10) Patent No.: US 8,089,443 B2
(45) Date of Patent: Jan. 3, 2012

(54) LIQUID CRYSTAL DISPLAY DEVICE AND DRIVING METHOD OF LIQUID CRYSTAL DISPLAY DEVICE USING N-TIME SPEED DRIVING TECHNIQUE

(75) Inventor: Ryo Tanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 853 days.

(21) Appl. No.: 11/825,241

(22) Filed: Jul. 5, 2007

(65) Prior Publication Data

US 2008/0007514 A1 Jan. 10, 2008

(30) Foreign Application Priority Data

Jul. 7, 2006 (JP) ..... P2006-187401

(51) Int. Cl.
*G09G 3/36* (2006.01)

(52) U.S. Cl. ..... 345/89; 345/99

(58) Field of Classification Search ..... 345/4–6, 345/101, 102, 87, 89, 96, 99
See application file for complete search history.

(56) References Cited

U.S. PATENT DOCUMENTS 5,844,534 A * 12/1998 Okumura et al. ..... 345/90
6,429,833 B1 * 8/2002 Ryeom et al. ..... 345/63
7,006,069 B2 * 2/2006 Tanaka et al. ..... 345/98
7,619,585 B2 * 11/2009 Bell et al. ..... 345/9
2001/0003446 A1 * 6/2001 Takafuji ..... 345/98
2001/0038369 A1 * 11/2001 Adachi et al. ..... 345/87
2002/0018038 A1 * 2/2002 Onishi et al. ..... 345/98
2002/0130830 A1 * 9/2002 Park ..... 345/99

FOREIGN PATENT DOCUMENTS

JP 5 88197 4/1993
JP 9 325715 12/1997
JP 11 271709 10/1999

* cited by examiner

*Primary Examiner* — Chanh Nguyen
*Assistant Examiner* — Ram Mistry
(74) *Attorney, Agent, or Firm* — Frommer Lawrence & Haug LLP; William S. Frommer; Thomas F. Presson

(57) ABSTRACT

A liquid crystal display device is formed by laminating first and second liquid crystal panels, the liquid crystal panels being each formed by disposing a liquid crystal layer between two transparent substrates arranged so as to be opposed to each other and two-dimensionally arranging pixels in a form of a matrix on one of the two substrates, and disposing a backlight on a side of the first liquid crystal panel. The liquid crystal display device also includes: a first driver to drive the first liquid crystal panel on a side of the backlight by n-time speed driving in which one frame period is divided into n fields; and a second driver to drive the second liquid crystal panel on a display surface side by normal driving in which one frame period is not divided.

13 Claims, 10 Drawing Sheets

SECOND LIQUID CRYSTAL PANEL

FIRST LIQUID CRYSTAL PANEL

DISPLAY DEVICE AS A WHOLE

FIG. 8A SECOND LIQUID CRYSTAL PANEL

FIG. 8B FIRST LIQUID CRYSTAL PANEL

FIG. 8C DISPLAY DEVICE AS A WHOLE

LIQUID CRYSTAL DISPLAY DEVICE AND DRIVING METHOD OF LIQUID CRYSTAL DISPLAY DEVICE USING N-TIME SPEED DRIVING TECHNIQUE

CROSS REFERENCES TO RELATED APPLICATIONS

The present invention contains subject matter related to Japanese Patent Application JP 2006-187401, filed in the Japan Patent Office on Jul. 7, 2006, the entire contents of which being incorporated herein by reference.

BACKGROUND OF THE INVENTION

1. Field of the Invention

The present invention relates to a liquid crystal display device and a driving method of the liquid crystal display device, and particularly to an active matrix type liquid crystal display device that controls display in pixel units, and a driving method of the liquid crystal display device.

2. Description of the Related Art

The liquid crystal display device is now widely used in portable terminals, PC (personal computer) monitors, devices for commercial use, and digital TVs because of reduced thickness, light weight, and low power consumption of the liquid crystal display device. For TV use, in particular, the liquid crystal display device is compared with a CRT (Cathode Ray Tube) conventionally spread widely, and the liquid crystal display device still has problems in terms of dark-place contrast, response speed (moving image characteristics) and the like.

The liquid crystal display device has a structure in which light is emitted from a backlight under a liquid crystal panel, while each pixel of the liquid crystal panel functions as a shutter of the light. The liquid crystal display device cannot completely shut out light at a time of black display, and thus has contrast lowered in a dark place. As to the lowered contrast in a dark place, black luminance can be made lower than before by reducing the diameter of pigment particles of color filters, improvements of polarizing films and the like, and performing panel design such that liquid crystal molecules are aligned in an appropriate direction in an entire area within a pixel. However, light still cannot be completely blocked at a time of black display.

There is a technique of controlling the luminance of a backlight according to brightness while monitoring the luminance level of an input video signal. With CCFLs (Cold Cathode Fluorescent Lamps) widely used as backlight for liquid crystal display devices, local luminance control cannot be performed. Thus, in video in which a light part and a dark part are displayed simultaneously, adverse effect is produced on display of either the light part or the dark part.

As one of methods for improving the contrast, there is a conventionally known technique that controls luminance in pixel units by two laminated liquid crystal panels, and makes it possible to make black display up to a square of contrast of a single panel by making the two liquid crystal panels display black at a time of black display. For example, refer to Japanese Patent Laid-Open Nos. Hei 3-055592 and Hei 3-113427 for more information.

As to the response speed of the liquid crystal display device, liquid crystal molecules themselves are slow in response. There is a problem in particular of occurrence of a blur in a moving image as a result of the response being incomplete within one frame under a condition of a low gradation or a low temperature. In addition, because the liquid crystal display device is a hold type device in which a backlight illuminates at all times, and pixels continue being lit (continue holding a video signal), a blur in a moving image and a residual image are caused by the hold type display.

As a technique for improving the moving image characteristics (response speed) of the liquid crystal display device, an overdrive technique is known. In general, this overdrive technique basically monitors a gradation change by comparing a present frame and a previous frame with each other, and when a gradation change is detected, applies a voltage higher than a gradation voltage to be reached in only one frame in which the change is detected.

In order to improve the moving image characteristics, however, the hold type device needs to be changed to an impulse type device in which pixels blink. As techniques for improving the moving image characteristics, a scan backlight technique, black insertion and the like are widely known.

The former scan backlight technique turns off a backlight (or reduces light) for a specific time of one frame period in synchronism with timing of writing of a data signal. However, it is impossible to turn off the backlight in the same timing for all pixels in writing each pixel because the scan backlight technique turns on/off the backlight in units of regions, and a leakage of light from a region being lit into an unlit region is inevitable.

The latter black insertion is a technique of writing black in every other frame on a data signal. This black insertion is difficult to realize because the black insertion involves flicker and leads directly to a decrease in luminance as in controlling the luminance of the backlight.

Further, there is n-time speed driving as a technique for a better appearance of a moving image. This n-time speed driving improves response speed by increasing a normal vertical frequency 1.5 times or twice or more and also making use of overdrive. In addition, pseudo impulse driving is realized by selecting a gradation to be written in each of a plurality of fields divided within each frame.

In a case of double speed, for example, a data signal is written in a first field within one frame at a time of normal driving, and black is written in a second field, whereby an optical waveform is a sawtooth waveform, that is, an impulse type waveform.

Combinations of the techniques such as the overdrive technique, the scan backlight technique, black insertion, and n-time speed driving as described above have improved the moving image characteristics of the liquid crystal display device beyond comparison to the moving image characteristics in the past. As a result, a rate of prevalence of liquid crystal TVs, for example, has also been improved.

SUMMARY OF THE INVENTION

It is known, however, that even combinations of the techniques such as the overdrive technique, the scan backlight technique, black insertion, and n-time speed driving cannot achieve sufficient dark-place contrast and sufficient moving image characteristics in some uses of the display. Such uses of the display include for example business uses in a broadcasting industry and a medical industry. In the broadcasting industry, in particular, there is a master monitor for a video check before broadcasting. This master monitor is required to have a representing capability equal to that of a conventional CRT in gradation representation of a dark part and moving image characteristics on a level comparable to that of the CRT.

Accordingly, it is desirable to provide a liquid crystal display device and a driving method of the liquid crystal display device that use the technique for dramatically improving contrast by laminating a plurality of liquid crystal panels and which can achieve moving image characteristics (response characteristics) comparable to those of the CRT.

According to an embodiment of the present invention, a liquid crystal display device is formed by laminating at least two first and second liquid crystal panels, the liquid crystal panels being each formed by disposing a liquid crystal layer between two transparent substrates arranged so as to be opposed to each other and two-dimensionally arranging pixels in a form of a matrix on one of the two substrates, and disposing a backlight on a side of the first liquid crystal panel. The first liquid crystal panel on a side of the backlight is driven by n-time speed driving in which one frame period is divided into n fields and the second liquid crystal panel on a display surface side is driven by normal driving in which one frame period is not divided, or the first liquid crystal panel and the second liquid crystal panel are both driven by the n-time speed driving.

In the liquid crystal display device having the above-described constitution, the first liquid crystal panel is driven by n-time speed driving and the second liquid crystal panel is driven by normal driving, or the first liquid crystal panel and the second liquid crystal panel are both driven by the n-time speed driving. Thereby the display of the display device as a whole is an impulse type display in which pixels blink, which is a factor in improving moving image characteristics.

According to the present invention, it is possible to provide a liquid crystal display device and a driving method of the liquid crystal display device that use the technique for dramatically improving contrast by laminating a plurality of liquid crystal panels and which can achieve moving image characteristics (response characteristics) comparable to those of the CRT.

DETAILED DESCRIPTION OF THE PREFERRED EMBODIMENTS

Preferred embodiments of the present invention will hereinafter be described with reference to the drawings.

Figure 1:
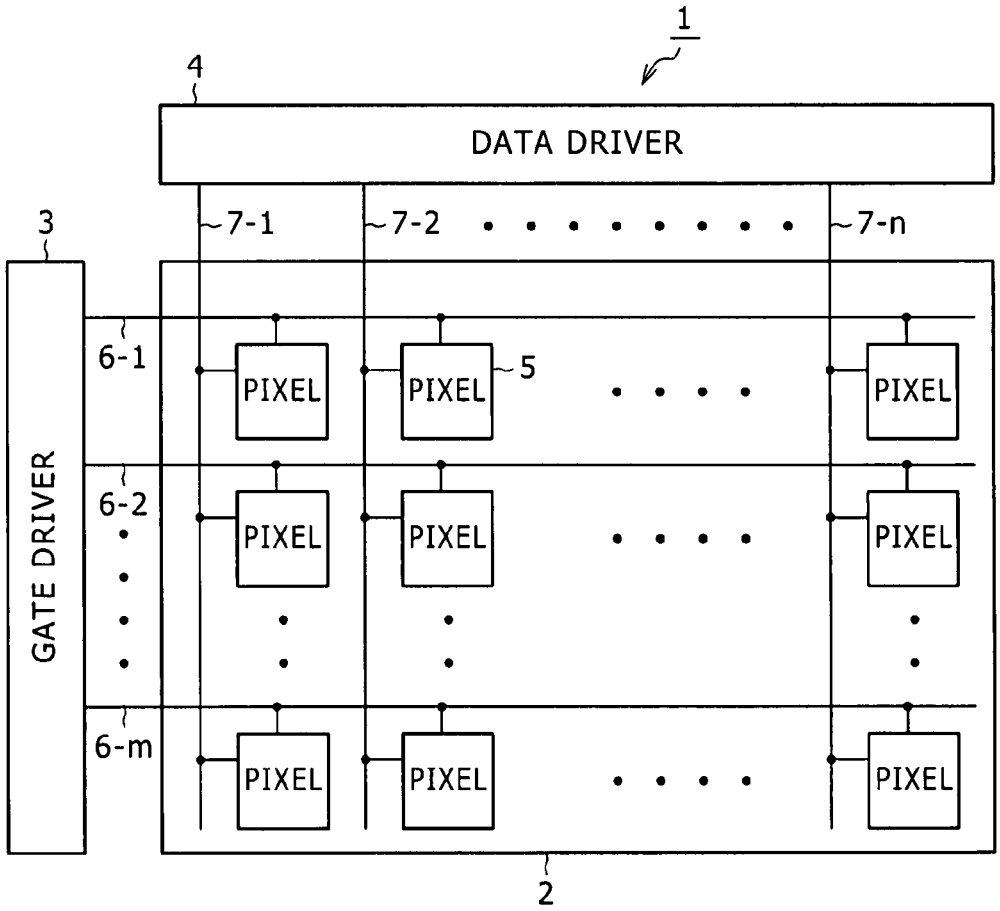
FIG. 1 is a block diagram showing a basic configuration of an active matrix type liquid crystal display device.

FIG. 1 is a block diagram showing a basic configuration of an active matrix type liquid crystal display device. As shown in FIG. 1, the active matrix type liquid crystal display device 1 includes a pixel array unit 2, a gate driver 3 forming a vertical driving system, and a data driver 4 forming a horizontal driving system as basic constituent elements.

(Pixel Array Unit)

The pixel array unit 2 is formed in a liquid crystal panel (not shown) of a panel structure in which two transparent substrates (not shown) are disposed in such a manner as to be opposed to each other, and a liquid crystal (liquid crystal layer) is filled between the two substrates. Specifically, on one substrate, unit pixels 5 are two-dimensionally arranged in the form of a matrix, scanning lines (gate lines) 6-1 to **6-*m* are arranged for each row of the pixel arrangement of m rows and n columns, and signal lines (data lines) 7-1 to 7-*n* are arranged for each column of the pixel arrangement. Transparent electrodes (pixel electrodes) are formed in pixel units on the one substrate (array substrate) on which the unit pixels 5** are formed, while one transparent electrode (counter electrode) is formed over an entire display area on the other substrate (counter substrate).

(Unit Pixel)

Figure 2:
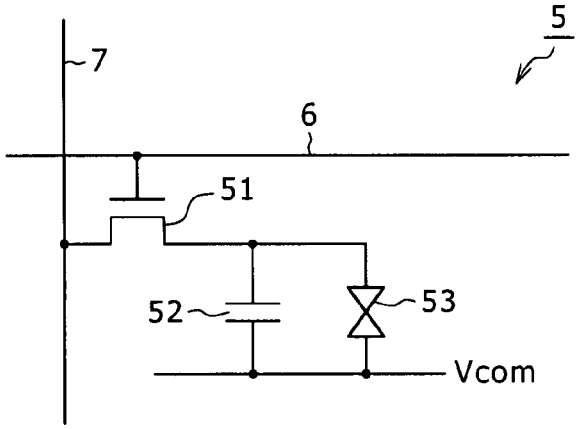
FIG. 2 is a circuit diagram showing an example of circuit configuration of a unit pixel.

FIG. 2 is a circuit diagram showing an example of circuit configuration of a unit pixel 5. As shown in FIG. 2, the unit pixel 50 includes a pixel transistor 51, a capacitive element 52, and a liquid crystal element (liquid crystal cell) 53. In the unit pixel 50, the pixel transistor 51 has a control electrode (gate electrode) connected to a scanning line 6 (6-1 to **6-*m*), and has an input electrode connected to a signal line 7 (7-1 to 7-*n*). A TFT (Thin Film Transistor), for example, is used as the pixel transistor 51**.

The capacitive element 52 has one terminal connected to an output electrode of the pixel transistor 51, and has another terminal grounded. The liquid crystal element 53 means a liquid crystal capacitance produced between a pixel electrode and the counter electrode, the counter electrode being formed in such a manner as to be opposed to the pixel electrode. The pixel electrode is connected to the output electrode of the pixel transistor 51. As described above, the counter electrode of the liquid crystal element 53 is formed by one transparent electrode common to the pixels over the entire display area. A common potential Vcom common to the pixels is applied to the counter electrode.

In the unit pixel 5, when a voltage corresponding to a video signal is applied from the signal line 7 (7-1 to **7-*n*) to the pixel electrode of the liquid crystal element 53 via the pixel transistor 51, polarization properties of the liquid crystal are changed according to the applied voltage, whereby the liquid crystal element 53 makes a gradation display corresponding to the applied voltage. This applied voltage is retained by the capacitive element 52. Thus, the polarization properties of the liquid crystal are continuously maintained by the voltage retained by the capacitive element 52 even after the pixel transistor 51** is turned off.

(Gate Driver)

The gate driver 3 is formed by a shift register, an address decoder or the like. The gate driver 3 outputs, in order, vertical scanning pulses (scanning voltages) for selecting unit pixels 5 in row units, and supplies the vertical scanning pulses to the pixel array unit 2 via the scanning lines 6-1 to **6-*m***.

(Data Driver)

The data driver 4 is formed by a shift register, an address decoder or the like. The data driver 4 writes a video signal (signal voltage) for units of one pixel unit, units of a predetermined number of pixels, or a unit of one row (unit of one line) to pixels 5 in a pixel row selected by the gate driver 3 via the signal lines 7-1 to **7-*n***.

Embodiments

Figure 3:
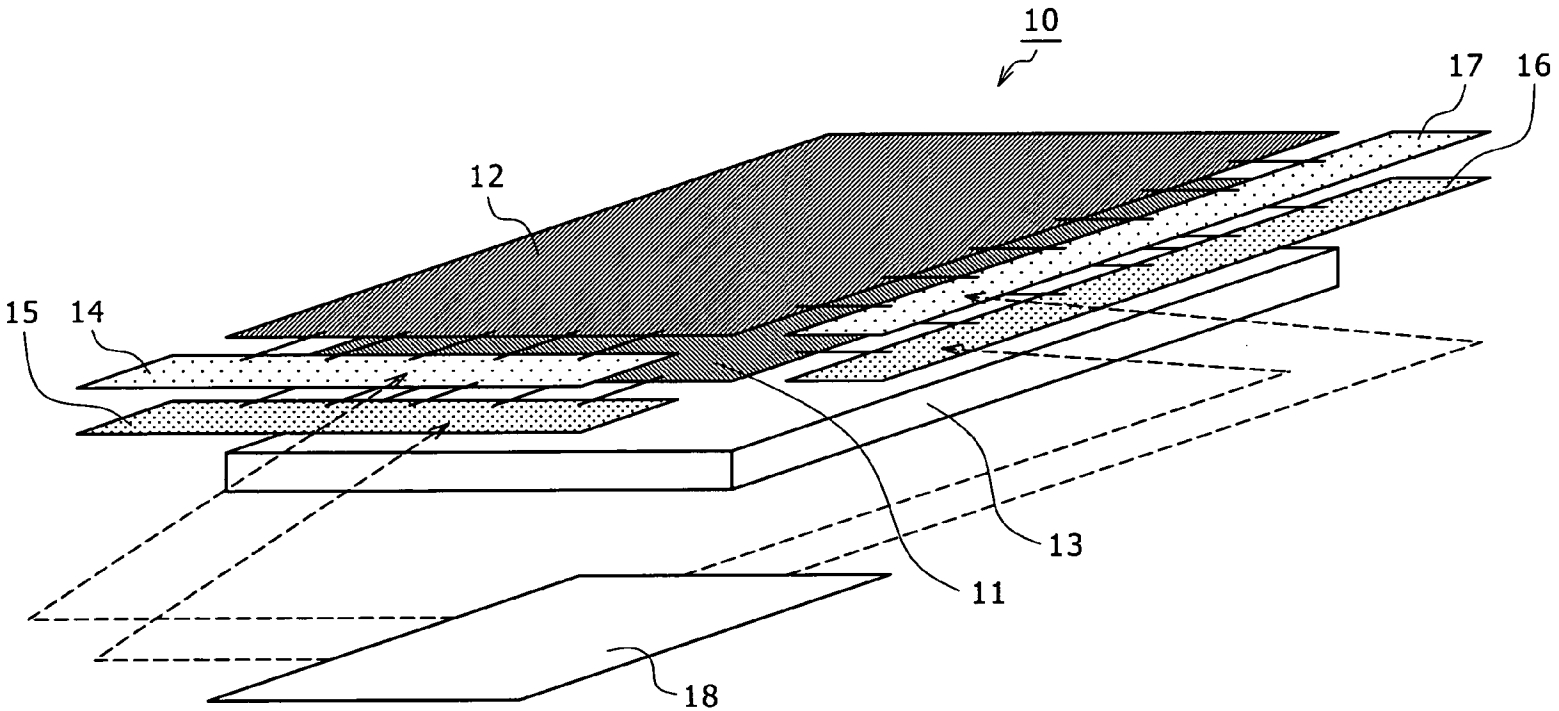
FIG. 3 is a conceptual diagram schematically showing a system configuration of a liquid crystal display device according to an embodiment of the present invention.

FIG. 3 is a conceptual diagram schematically showing a system configuration of a liquid crystal display device according to an embodiment of the present invention. As shown in FIG. 3, the liquid crystal display device 10 according to the present embodiment has a structure in which a plurality of liquid crystal panels, for example two first and second liquid crystal panels 11 and 12 are laminated in order from the bottom of FIG. 3 such that optical axes of pixels of the liquid crystal panels 11 and 12 coincide with each other, a backlight unit 13 is disposed on the side of the first liquid crystal panel 11 on the lower side, and light emitted from the backlight unit 13 is transmitted in order by the pixels of the first and second liquid crystal panels 11 and 12 according to transmittance of the pixels.

The first and second liquid crystal panels 11 and 12 have basically the same structure. Specifically, as shown in FIG. 1, the first and second liquid crystal panels 11 and 12 each have a panel structure in which a substrate on which unit pixels 5 of a pixel array unit 2 are arranged in the form of a matrix, scanning lines 6-1 to **6-*m* are arranged for each row, and signal lines 7-1 to 7-*n*** are arranged for each column and a substrate on which one counter electrode common to the pixels is formed over an entire display area are arranged in such a manner as to be opposed to each other, and in which structure a liquid crystal is filled between the two substrates.

Around the first and second liquid crystal panels 11 and 12, gate driver substrates 14 and 15 and data driver substrates 16 and 17 are arranged so as to correspond to the respective panels. The gate driver 3 shown in FIG. 1 is formed on each of the gate driver substrates 14 and 15. The data driver 4 shown in FIG. 1 is formed on each of the data driver substrates 16 and 17. The first and second liquid crystal panels 11 and 12 are electrically connected to the gate driver substrates 14 and 15 and the data driver substrates 16 and 17 by a flexible substrate, a cable or the like.

Further, a driving circuit substrate 18 is provided as a substrate around the first and second liquid crystal panels 11 and 12. The driving circuit substrate 18 has a driving circuit to be described later formed therein for driving the respective gate drivers 3 on the gate driver substrates 14 and 15 and the respective data drivers 4 on the data driver substrates 16 and 17. The driving circuit substrate 18 is electrically connected to the gate driver substrates 14 and 15 and the data driver substrates 16 and 17 by a flexible substrate, a cable or the like.

According to the liquid crystal display device having the structure in which a plurality of liquid crystal panels, or two liquid crystal panels 11 and 12 in this case, are thus laminated, the first and second liquid crystal panels 11 and 12 both make black display at a time of black display, whereby the second liquid crystal panel 12 blocks light leaked by the first liquid crystal panel 11 on the backlight unit 13 side. It is known that consequently black display up to a square of contrast of a single panel can be made and thus a dramatic improvement in contrast can be achieved.

Figure 4:
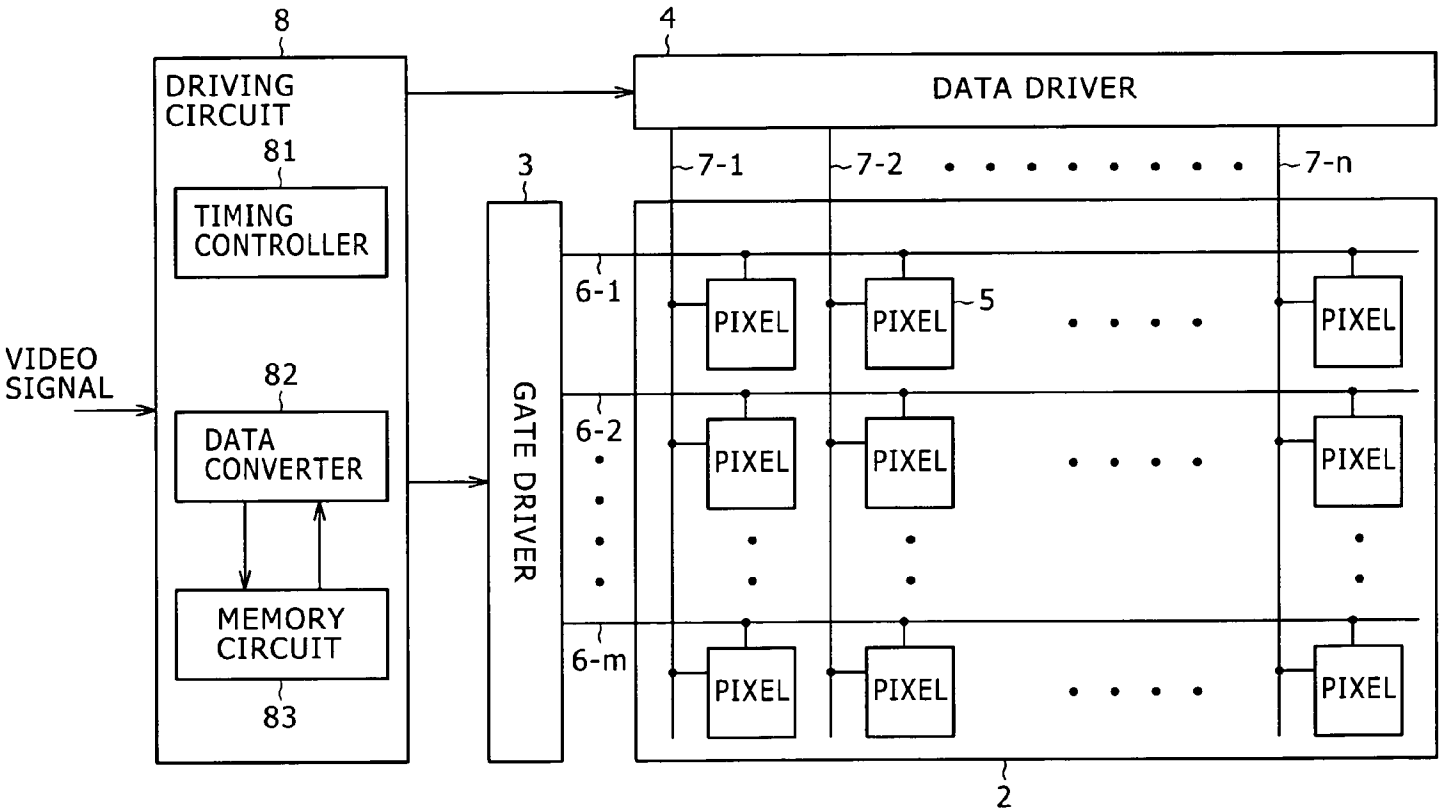
FIG. 4 is a block diagram schematically showing a circuit configuration of a liquid crystal display device according to an embodiment of the present invention.

FIG. 4 is a block diagram schematically showing a circuit configuration of a liquid crystal display device according to an embodiment of the present invention. In FIG. 4, similar parts to those of FIG. 1 are identified by the same reference numerals. In order to simplify the figure, a pixel array unit 2, a gate driver 3, and a data driver 4 of one of a first liquid crystal panel 11 and a second liquid crystal panel 12 are shown in FIG. 4.

In FIG. 4, a driving circuit 8 for driving the gate driver 3 and the data driver 4 includes a timing controller 81, a data converter 82, and a memory circuit 83. A video signal to be written to each unit pixel 5 in the pixel array unit 2 is input as a data signal to the driving circuit 8.

The timing controller 81 performs for example timing control on the gate driver 3 for selecting and scanning unit pixels 5 of the pixel array unit 2 in a row unit, timing control on the data driver 4 for writing a data signal (video signal) to each of the unit pixels 5 of the pixel array unit 2, and timing control on the data converter 82 for data conversion.

The data converter 82 has a data conversion table to correct the data voltage of a video signal. Specifically, the data converter 82 compares data signals of a previous frame and a present frame with each other using the memory circuit 83 having a memory capacity for one frame, reads a correction value in the data conversion table on the basis of a result of the comparison, and corrects the data voltage by adding the correction value to the data signal of fields of the present frame. The above-described overdrive function can be realized by this correction of the data converter 82.

The driving circuit 8 having the above-described configuration corresponds to a first driving unit for driving the first liquid crystal panel 11, and corresponds to a second driving unit for driving the second liquid crystal panel 12. The two driving circuits 8 as the first driving unit and the second driving unit drive the first and second liquid crystal panels 11 and 12 while synchronizing respective input signals for the liquid crystal panels 11 and 12 with each other.

The liquid crystal display device according to the present embodiment having such a configuration is characterized by achieving moving image characteristics (response characteristics) comparable to those of a CRT in addition to using techniques for dramatically improving contrast by a laminated structure of at least two first and second liquid crystal panels 11 and 12. Concrete embodiments of the liquid crystal display device will be described in the following. Incidentally, description of each of the following embodiments will be made by taking as an example a case where one frame period is equally divided into two fields (n=2) for simplicity.

First Embodiment

A liquid crystal display device according to a first embodiment performs normal driving of a second liquid crystal panel 12 and performs double-speed driving of a first liquid crystal panel 11 under driving by a driving circuit 8. In this case, normal driving refers to driving at a frequency (driving frequency) of an input signal (video signal), that is, driving in which one frame period is not divided. Hence, double-speed driving refers to driving at a frequency twice the frequency of the input video signal.

Figures 5A, 5B, 5C:
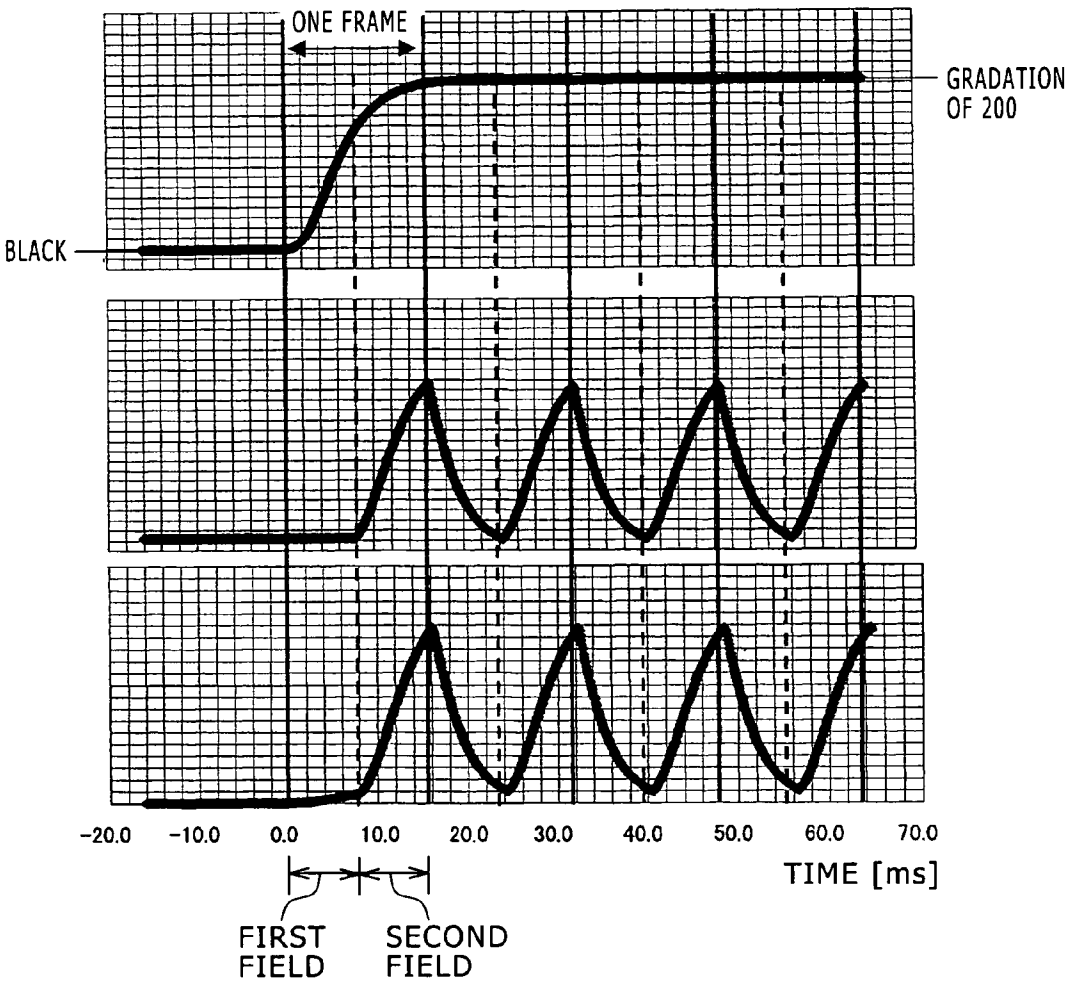
FIGS. 5A, 5B, and 5C are waveform charts showing the response waveforms of a first liquid crystal panel and a second liquid crystal panel in a liquid crystal display device according to a first embodiment and the display device as a whole.

In the liquid crystal display device that thus performs the double-speed driving of the first liquid crystal panel 11 and the normal driving of the second liquid crystal panel 12, when the response waveform of the second liquid crystal panel 12 is a waveform as shown in FIG. 5A in which a transient change is made from a black gradation to a predetermined gradation (for example a gradation of 200) in the period of one frame, and the first liquid crystal panel 11 is driven such that a black gradation voltage is applied in a first field and a white gradation voltage is applied in a second field, the response waveform of the first liquid crystal panel 11 is a sawtooth waveform as shown in FIG. 5B.

It is desirable that response speed be 0 ms, that is, that the optical response of the liquid crystal panel start instantly at a moment when data voltage is changed. However, the slow response of liquid crystal molecules, as indicated by a rising edge of the response waveform shown in FIG. 5A, and a hold type display being lit at all times induce blurring of a moving image.

Therefore, in the liquid crystal display device according to the first embodiment, the driving of the first liquid crystal panel 11 is set such that the response waveform becomes a sawtooth waveform as shown in FIG. 5B. The first liquid crystal panel 11 has a function (action) of controlling an amount of light entering the second liquid crystal panel 12. As a result of the action of the first liquid crystal panel 11, the optical waveform of the liquid crystal panels 11 and 12 as a whole is a sawtooth waveform as shown in FIG. 5C. Consequently, the display of the first and second liquid crystal panels 11 and 12, that is, the display of the display device as a whole becomes an impulse type display in which pixels blink.

That is, a basic concept of the method of driving the liquid crystal panels 11 and 12 in the liquid crystal display device according to the first embodiment is based on the turning off of a backlight during the period of transient response of a liquid crystal and the turning on of the backlight at a time of completion of response in the above-described scan backlight technique. The driving method of the liquid crystal display device according to the first embodiment is none other than a method of controlling, in pixel units, a similar function to the turning on/off of the backlight.

With the scan backlight technique, as described above, the backlight is turned on/off in each region. Therefore, generally, in liquid crystal driving in which data is written from an upper part within a surface, timing of turning off the backlight cannot be made to be the same for all pixels. In addition, there is a leakage of light from another region. Thus, effect of improving moving image characteristics is insufficient.

In contrast to the scan backlight technique, according to the driving method of the liquid crystal display device according to the first embodiment, it is possible to surely make an impulse type display, which is a factor in improving moving image characteristics, in pixel units, and thus enhance the effect of improving moving image characteristics (response characteristics) and thereby achieve moving image characteristics comparable to those of a CRT.

Incidentally, the liquid crystal display device performs alternating-current driving as liquid crystal driving. This is to prevent degradation of liquid crystal material. In the case of double speed, particularly in a case where two gradations are repeated, it is necessary to reverse polarity in units of one frame. That is, in the case where two gradations are repeated, the polarity of a first field and a second field of an mth frame is made to be positive polarity, and the polarity of a first field and a second field of an (m+1)th frame is made to be negative polarity (the same is true for double speed in the following).

In addition, in FIG. 5B, it is effective to apply a gradation voltage that is not a gradation voltage of black in the first field of the first liquid crystal panel 11 and apply a gradation voltage that is not a gradation voltage of white in the second field. When a maximum voltage and a minimum voltage that can be applied to the first liquid crystal panel 11 are voltages of white and black, respectively, overdrive cannot be used. It is therefore effective to select gradations that enable the use of overdrive so that response is completed within one field.

Specifically, it is desirable to use a predetermined first gradation, for example a low gradation of about 50 or less in the first field, and use a second gradation higher than the first gradation, for example a high gradation of 200 or more in the second field. This method can also enhance response in the second field because the application of a voltage that is not the voltage of black before liquid crystal response in the second field gives a pretilt angle to liquid crystal molecules.

Generally, in a case of liquid crystal response from black in a VA (Vertically Aligned) mode, the liquid crystal starts response after determining a direction in which the liquid crystal molecules fall. A time taken to determine the direction in which the liquid crystal molecules fall makes response speed slow. Thus the application of a gradation voltage that is not the gradation voltage of black in the first field enhances response in the second field.

In this driving method, because the same two gradations are repeated in the first liquid crystal panel 11 at all times, a $\gamma$ representation of the display device as a whole is equal to $\gamma$ of the second liquid crystal panel 12.

Second Embodiment

Supposing the normal driving of a second liquid crystal panel 12 and the double-speed driving of a first liquid crystal panel 11 under driving by a driving circuit 8, a liquid crystal display device according to a second embodiment changes repetitive gradations of the first liquid crystal panel 11, or specifically changes gradations in a first field and a second field, according to display of the second liquid crystal panel 12.

In the liquid crystal display device according to the first embodiment, the first liquid crystal panel 11 repeats the same gradations irrespective of input level of the second liquid crystal panel 12. In this case, a leakage of light occurs when the second liquid crystal panel 12 has the gradation voltage of black. This cancels out the effect of enhancing the ability to represent black by laminating the two liquid crystal panels 11 and 12.

On the other hand, the liquid crystal display device according to the second embodiment changes repetitive gradations of the first liquid crystal panel 11, that is, makes the first liquid crystal panel 11 display black in both fields at least in the case where the gradation voltage of black is applied to the second liquid crystal panel 12. Thereby a black representation has a value as indicated by a theoretical value of contrast.

In this case, however, when the second liquid crystal panel 12 has a gradation of one, a difference in luminance from black is increased. Thus, when the second liquid crystal panel 12 is between a gradation of one and a low gradation, a method is adopted which changes the gradation in the second field of the first liquid crystal panel 11 stepwise so as to achieve an appropriate gradation luminance of the display device. This changing method is determined by factors governed by the liquid crystal panels being used and $\gamma$ of target low gradations after measurements are made on an actual device.

Third Embodiment

Supposing the normal driving of a second liquid crystal panel 12 and the double-speed driving of a first liquid crystal panel 11 under driving by a driving circuit 8, a liquid crystal display device according to a third embodiment changes the gradation in each field of the first liquid crystal panel 11 according to the display gradation of the second liquid crystal panel 12, whereby the ability to represent black is maintained while moving image characteristics (response characteristics) are improved.

In a panel structure in which the two liquid crystal panels 11 and 12 are laminated, γ of the display device is determined by multiplying together γ of the first liquid crystal panel 11 and γ of the second liquid crystal panel 12. The combinations of γ of the first liquid crystal panel 11 and γ of the second liquid crystal panel 12 are countless. An example of a γ combination is illustrated in the following. However, this combination is an example, and there is no limitation on the combinations.

Figure 6:
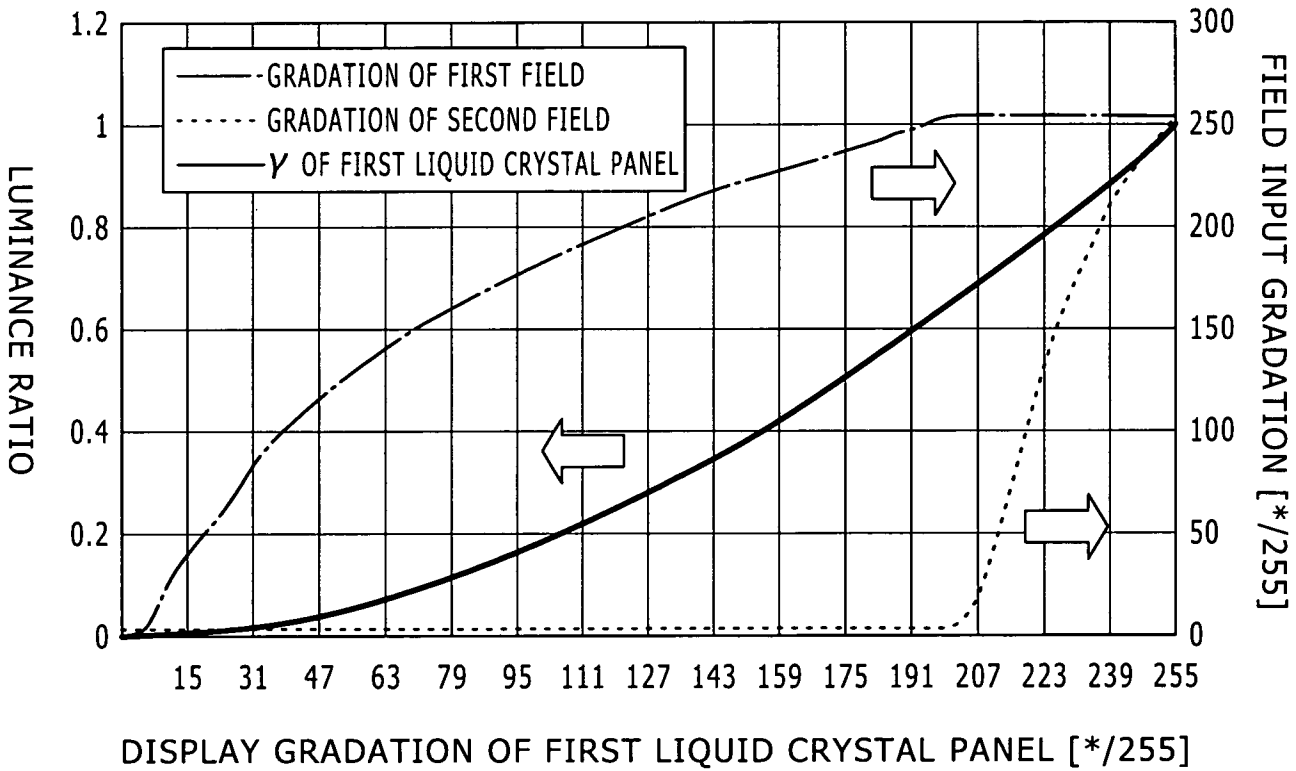
FIG. 6 is a diagram showing characteristics of panel display gradation of a first liquid crystal panel versus field input gradation.

Suppose that γ of the first liquid crystal panel 11 is 1.8. In this case, gradation representation in each field can be set as shown in FIG. 6, for example. Specifically, γ (=1.8) of the first liquid crystal panel 11 is formed (a solid line in FIG. 6) by applying a low gradation voltage in the first field up to a certain gradation (a dotted line in FIG. 6) and applying a white voltage in the second field at above the certain gradation (alternate long and short dash lines in FIG. 6).

The characteristic diagram of FIG. 6 shows that as an example, supposing that the display gradation of the first liquid crystal panel 11 is 191, when a gradation of 10 or less is input in the first field and a gradation of about 250 is input in the second field, the luminance ratio of the first liquid crystal panel 11 is about 0.6 with 1 for white.

Figure 7:
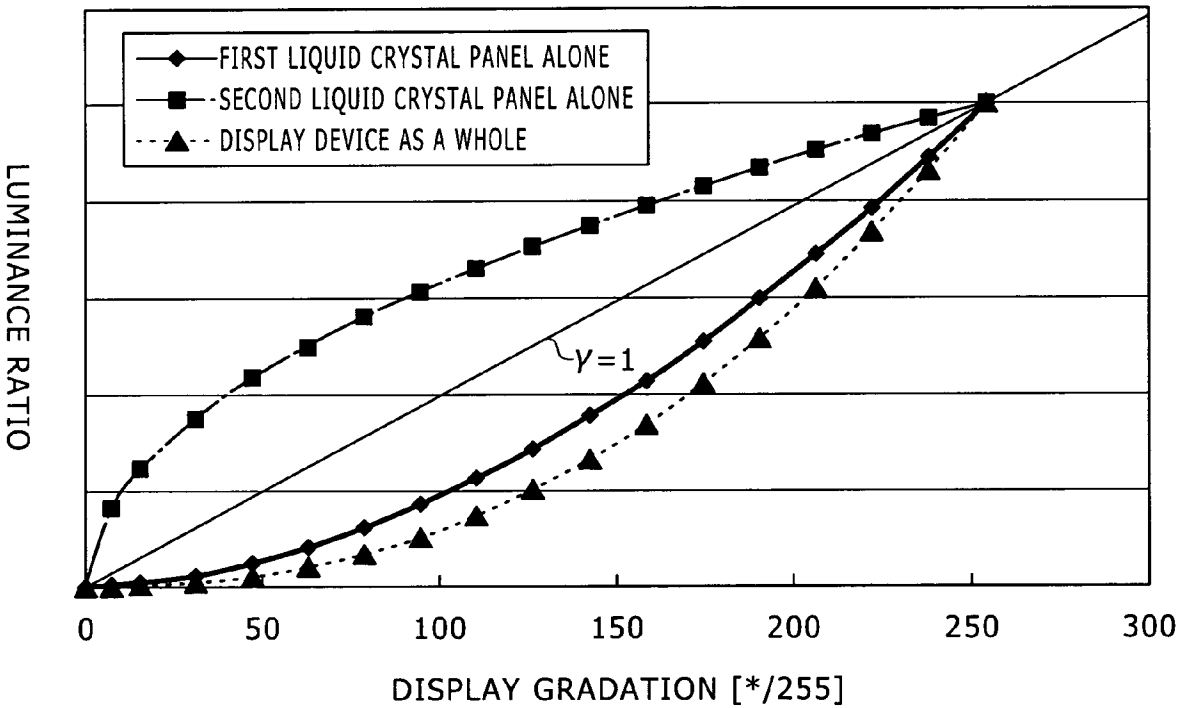
FIG. 7 is a diagram showing characteristics of display gradation versus luminance ratio of a first liquid crystal panel, a second liquid crystal panel, and a display device as a whole.

In this case, to maintain γ of the display device as a whole at 2.2, γ of the second liquid crystal panel 12 needs to be set about 0.5, as shown in FIG. 7. A solid line in FIG. 7 corresponds to the solid line in FIG. 6, and represents γ of the first liquid crystal panel 11 alone. Alternate long and short dash lines represent γ of the second liquid crystal panel 12 alone. A dotted line represents γ of the display device as a whole.

The liquid crystal display device according to the third embodiment with this gradation setting has the following advantages in addition to the realization of impulse type display by the liquid crystal display device according to the first embodiment.

- When γ of the second liquid crystal panel 12 is set to one or less, a use region of a slow response part at low gradations is narrow, and thus fast response can be realized over a wide range of gradations.
- The application of a low gradation voltage in the first field in the first liquid crystal panel 11 gives a pretilt angle to the liquid crystal, so that response in the second field is improved.
- The first liquid crystal panel 11 makes black/white display in both fields when the second liquid crystal panel 12 makes black/white display, so that black can be represented and a decrease in luminance at the time of white display can be minimized.

Because the effect of realizing impulse type display is increased as the response of the liquid crystals of both the first and second liquid crystal panels 11 and 12 is enhanced, the liquid crystal display device according to the third embodiment can improve moving image characteristics. In this case, however, impulse type display is not made on a high gradation side, and thus there is a defect regarding moving image characteristics at high gradations.

Fourth Embodiment

A liquid crystal display device according to a fourth embodiment drives both a first liquid crystal panel 11 and a second liquid crystal panel 12 by double-speed driving under driving by a driving circuit 8. In this case, different gradations are applied to the second liquid crystal panel 12 in different fields as shown in FIG. 6. In the first liquid crystal panel 11, the gradation voltage of white is applied in a first field, and the gradation voltage of black is applied in a second field.

As described above, because the first liquid crystal panel 11 only repeats same two gradations, γ of the display device as a whole is determined by γ of the second liquid crystal panel 12. Hence, while it is assumed that γ=1.8 in FIG. 6, a gradation in each field needs to be determined so as to be adjusted to a target γ of the display device.

Figure 8:
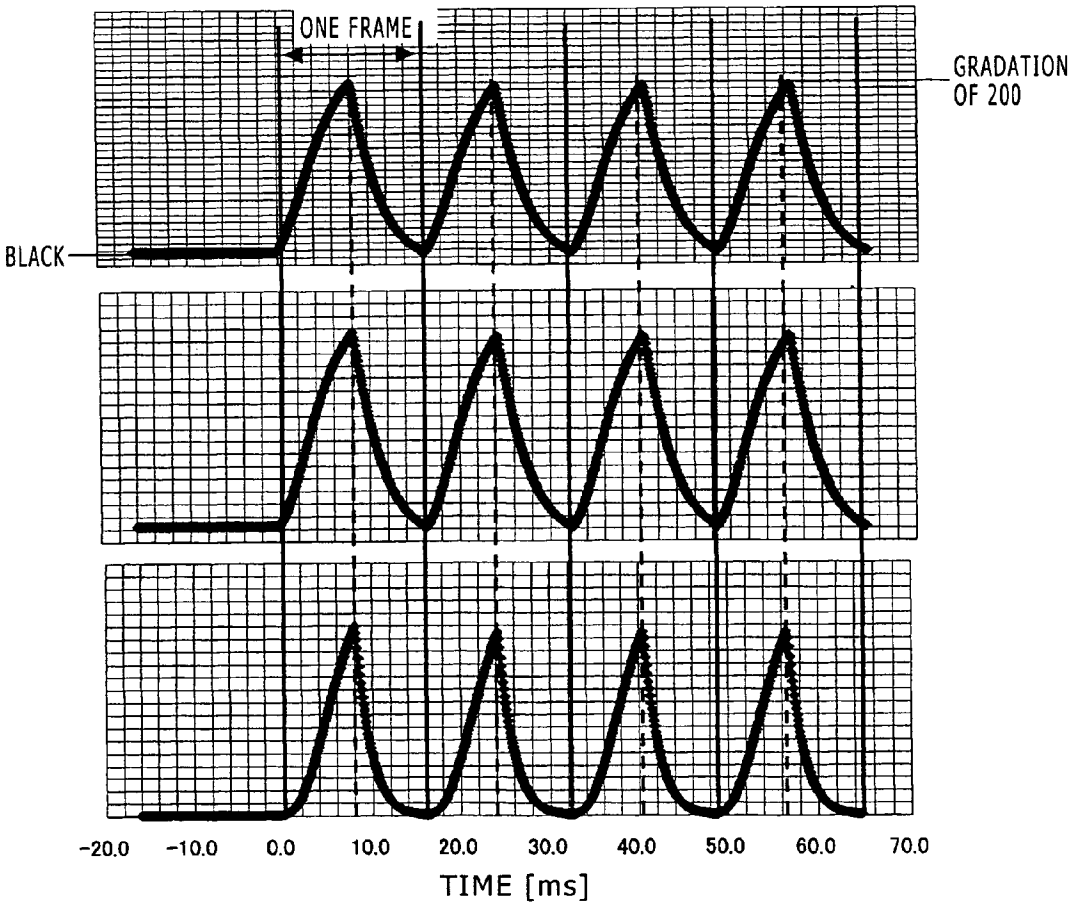
FIGS. 8A, 8B, and 8C are waveform charts showing the response waveforms of a first liquid crystal panel and a second liquid crystal panel in a liquid crystal display device according to a fourth embodiment and the display device as a whole.

The response waveforms of the first and second liquid crystal panels 11 and 12 and the display device as a whole in this case are waveforms as shown in FIGS. 8A, 8B, and 8C. Specifically, the second liquid crystal panel 12 exhibits a response from black to a gradation of 200. The response waveforms of the first and second liquid crystal panels 11 and 12 as shown in FIGS. 8B and 8A, respectively, are both a sawtooth waveform.

It is to be noted that the response waveform of the display device as a whole as shown in FIG. 8C is a sharper waveform than the response waveforms, that is, the sawtooth waveforms of the first and second liquid crystal panels 11 and 12 as shown in FIGS. 8B and 8A, respectively. This is an effect of multiplying together the waveforms of the first liquid crystal panel 11 and the second liquid crystal panel 12. Because of more obvious impulse type display than that of the liquid crystal display device according to the first embodiment, moving image characteristics are further improved.

Incidentally, as in the first embodiment, the display gradations of the first liquid crystal panel 11 shown in FIG. 8B may not be the display gradations of black and white. By using a low gradation that is not the gradation of black and a high gradation that is not the gradation of white, it is possible to apply overdrive and thus enhance liquid crystal response.

It is desirable that when the second liquid crystal panel 12 displays black, the first liquid crystal panel 11 display black in both the two fields. In this case, as described in the second embodiment, representation of a low gradation such as a gradation of one, a gradation of two or the like becomes unnatural. It is therefore desirable that one of the following measures be taken at the time of low-gradation display by the display device as a whole.

- The gradations in the first field and the second field of the first liquid crystal panel 11 are set so as to be adjusted to the low-gradation luminance of the display device as a whole.
- The gradations in the first field and the second field of the second liquid crystal panel 12 are set considering that the first liquid crystal panel 11 is set to be driven to repeat two gradations.

By taking one of the measures, it is possible to make a natural low-gradation representation, and eliminate the problem of the liquid crystal display device according to the third embodiment, that is, the problem of being unable to make impulse type display at high gradations.

Fifth Embodiment

As with the liquid crystal display device according to the fourth embodiment, a liquid crystal display device according to a fifth embodiment performs the double-speed driving of both a first liquid crystal panel 11 and a second liquid crystal panel 12 under driving by a driving circuit 8. However, whereas in the liquid crystal display device according to the fourth embodiment, the black gradation or a low gradation and the white gradation or a high gradation are repeated as gradations input to the first liquid crystal panel 11, in the liquid crystal display device according to the fifth embodiment, on the other hand, different gradations for a first field and a second field are input to the first liquid crystal panel 11 as in the second liquid crystal panel 12, and the black gradation or a low gradation is applied in the second field up to a specific gradation and subsequently the white gradation voltage or a high gradation voltage is applied in the first field.

In the case of adopting the configuration of the liquid crystal display device according to the fifth embodiment, the field combination gradations of the first liquid crystal panel 11 and the second liquid crystal panel 12 need to be set so as to be adjusted to a target γ of the display device as a whole as in the liquid crystal display device according to the third embodiment. However, the liquid crystal display device according to the fifth embodiment can maintain high luminance more easily than the liquid crystal display device according to the fourth embodiment, and make liquid crystal response work favorably depending on the field combination gradations of the liquid crystal panels.

Sixth Embodiment

As with the liquid crystal display device according to the fourth embodiment, a liquid crystal display device according to a sixth embodiment performs the double-speed driving of both a first liquid crystal panel 11 and a second liquid crystal panel 12 under driving by a driving circuit 8. However, while the second liquid crystal panel 12 is driven by the double-speed driving, the same gradation is written to the second liquid crystal panel 12 in both two fields. The white gradation voltage or a high gradation voltage is applied in the first field of the first liquid crystal panel 11, and the black gradation voltage or a low gradation voltage is applied in the second field of the first liquid crystal panel 11.

In this case, basically, substantially the same effects as in the case of the liquid crystal display device according to the first embodiment in which the second liquid crystal panel 12 is driven by the normal driving are obtained. However, because the same gradation can be written twice within one frame period, liquid crystal response is enhanced depending on the gradation. This is because particularly in a case of response from a low gradation to a high gradation, the liquid crystal at a time of second writing is already at a gradation intermediate between the start gradation to the gradation to be reached, and thus effectively makes response from this intermediate gradation.

Thus enhancing liquid crystal response means not only an improvement of display of moving images but also an additional effect of reducing a loss of luminance. As a result, displayable luminance can be heightened.

Incidentally, the liquid crystal modes of the two laminated liquid crystal panels used in each of the foregoing embodiments are not specifically limited. Specifically, two liquid crystal panels in a same mode may be laminated and used, or two liquid crystal panels in different liquid crystal modes may be laminated and used. However, a combination of liquid crystal panels with good liquid crystal response is desirable.

In addition, while each of the foregoing embodiments has been described by taking as an example a case where one frame period is divided into equal times of two fields (n=2), fields in one frame may not be divided into equal times. Further, when the n division is performed, a dividing ratio of fields can be set arbitrarily.

First Example of Modification

Each of the foregoing embodiments is configured to perform the double-speed driving of one or both of the first and second liquid crystal panels 11 and 12. When the double-speed driving is performed, a time for writing data voltage is halved as compared with the normal driving, and therefore the writing capability of a pixel transistor 51 formed by a TFT, for example, (see FIG. 2) may become a problem. It is a well known fact that the writing capability of the pixel transistor 51 depends on temperature, and that low temperatures are disadvantageous because the mobility of a-Si (amorphous silicon) used in the pixel transistor 51 is decreased at low temperatures.

When the writing capability of the pixel transistor 51 becomes insufficient, a decrease in luminance and, in extreme cases, difference in capability between pixel transistors 51 within a surface cannot be absorbed, so that display quality is degraded. Of course, when the size of the pixel transistor 51 is increased, it is possible to improve the writing capability and thus avoid a problem caused by the insufficient writing capability, but there is a fear of a degrease in transmittance and a decrease in yield.

A liquid crystal display device according to a first example of modification to be described below is made to solve the problem of the insufficient writing capability of the pixel transistor 51 without causing a decrease in transmittance and a decrease in yield.

Figure 9:
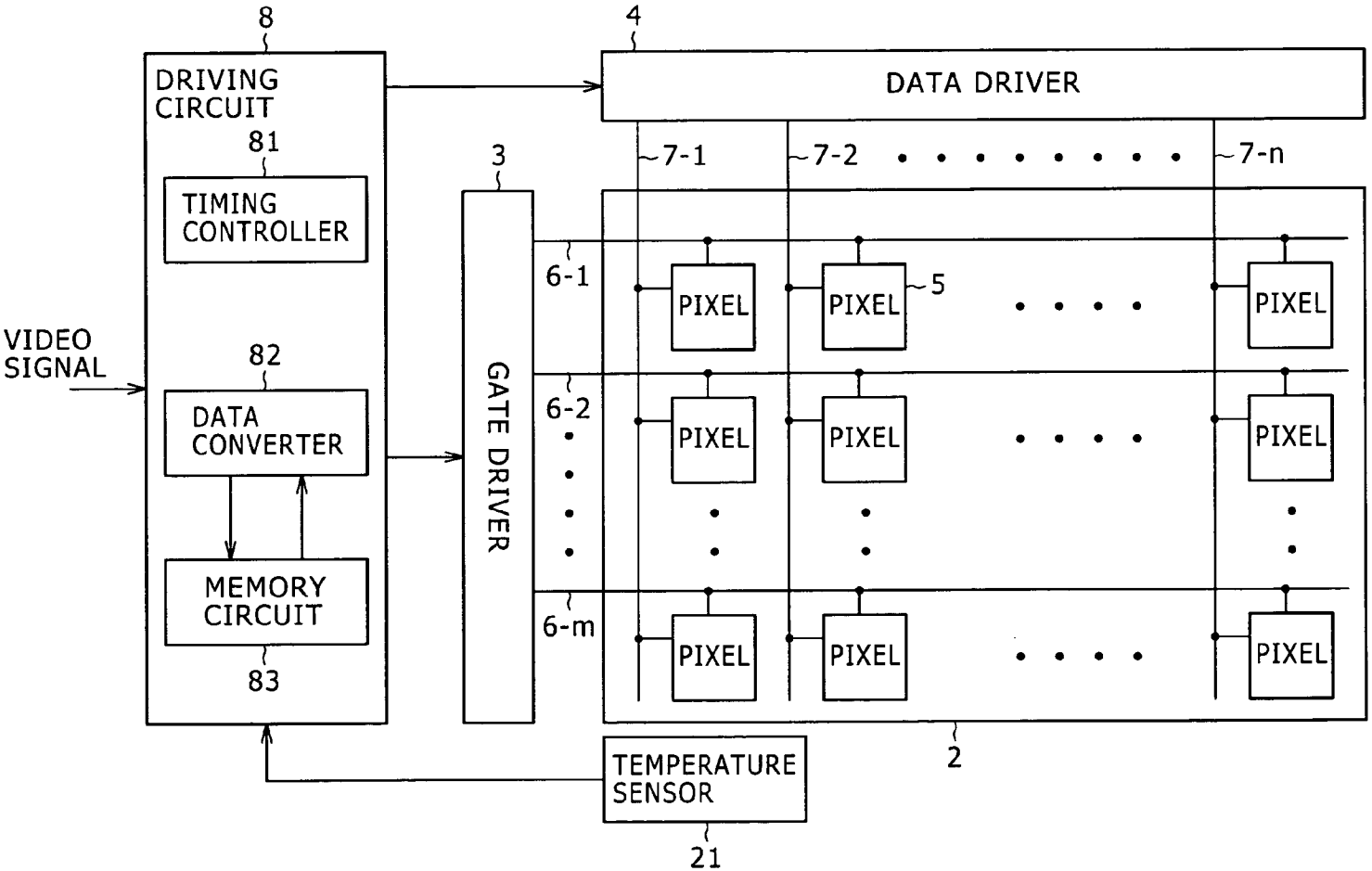
FIG. 9 is a block diagram schematically showing a circuit configuration of a liquid crystal display device according to a first example of modification of the present invention.

FIG. 9 is a block diagram schematically showing a circuit configuration of the liquid crystal display device according to the first example of modification of the present invention. In FIG. 9, similar parts to those of FIG. 4 are identified by the same reference numerals. In order to simplify the figure, a pixel array unit 2, a gate driver 3, and a data driver 4 of one of a first liquid crystal panel 11 and a second liquid crystal panel 12 are shown in FIG. 9.

As shown in FIG. 9, the liquid crystal display device according to the first example of modification has a temperature sensor (temperature measuring element) 21 for detecting the temperature of the present liquid crystal display device, preferably the first and second liquid crystal panels 11 and 12, the temperature sensor 21 being disposed within the display device, for example in the vicinity of the first and second liquid crystal panels 11 and 12 or on the liquid crystal panels 11 and 12. Under driving by a driving circuit 8, when the temperature detected by the temperature sensor 21 (the temperature of the liquid crystal display device) is a predetermined temperature or lower, a driving mode is changed from n-time speed driving to the normal driving.

Thus, in the liquid crystal display device configured to perform the double-speed driving of one or both of the first and second liquid crystal panels 11 and 12, the normal driving, rather than the n-time speed driving, is performed when the temperature of the liquid crystal display device is a predetermined temperature or lower. It is thereby possible to avoid the problem of the insufficient writing capability of the pixel transistor 51 depending on the temperature without causing a decrease in transmittance and a decrease in yield.

Incidentally, even when the normal driving is performed, moving picture response is not extremely degraded because under a low-temperature environment, liquid crystal response is inherently slow and thus there is a limit to the effect of display by the n-time speed driving. The temperature at which to change from the n-time speed driving to the normal driving is determined by the design of the pixel transistor 51, the mobility of a-Si, and the value of n of the n-time speed driving.

In addition, while in the first example of modification, the driving mode is changed from the n-time speed driving to the normal driving when the temperature of the liquid crystal display device is a predetermined temperature or lower, the present invention is not limited to the change to the normal driving, and a configuration that decreases the driving speed, or specifically changes from the n-time speed driving to (n−1)-time speed driving, (n−2)-time speed driving, . . . may be adopted.

Second Example of Modification

The writing capability of the pixel transistor 51 is also changed by driving frequency (frequency of an input video signal). This is because the pulse width of a vertical scanning pulse applied to the gate of the pixel transistor 51 is narrowed as the driving frequency is increased. A liquid crystal display device according to a second example of modification to be described below is made to solve the problem of the insufficient writing capability of the pixel transistor 51 due to change in the driving frequency.

Figure 10:
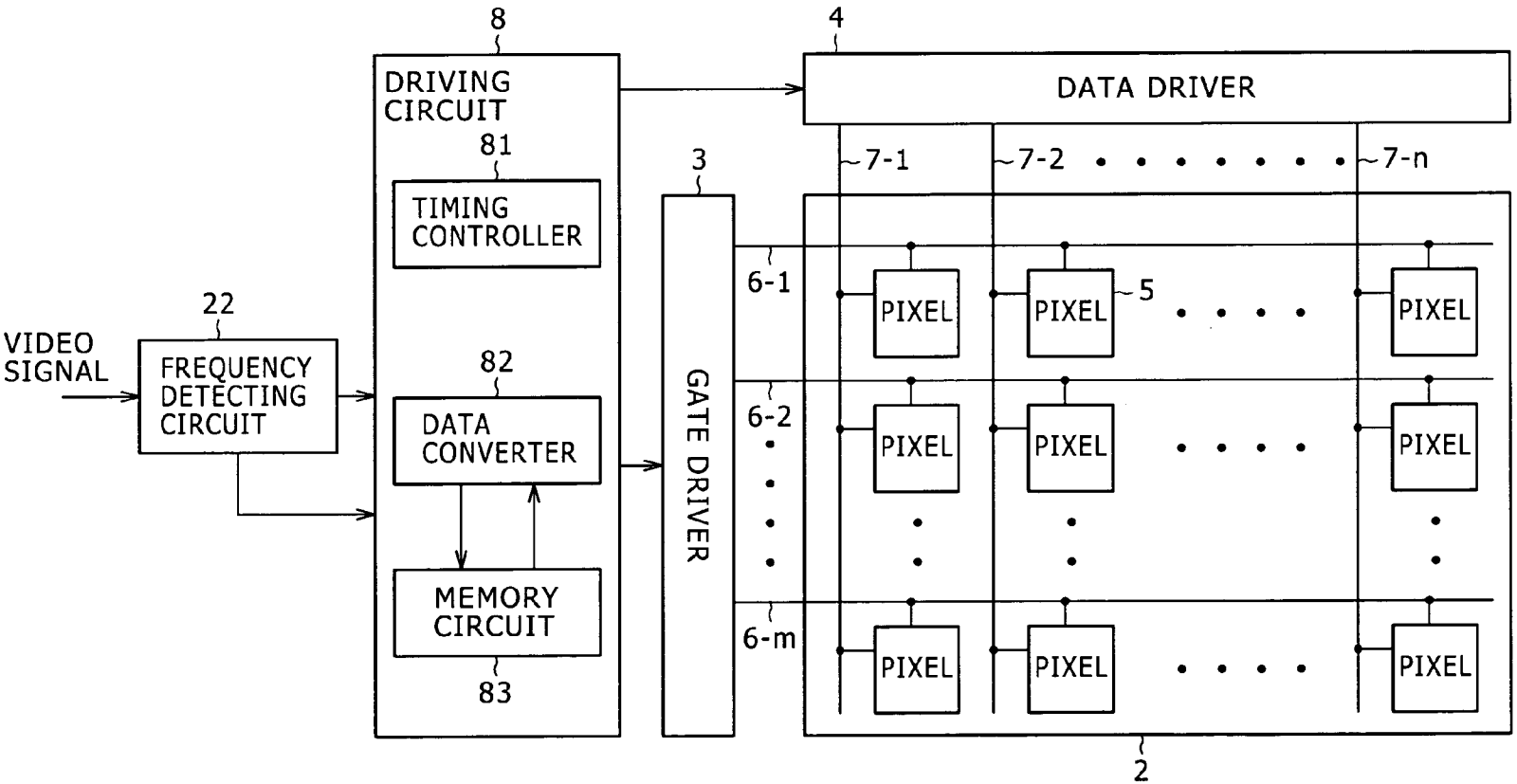
FIG. 10 is a block diagram schematically showing a circuit configuration of a liquid crystal display device according to a second example of modification of the present invention.

FIG. 10 is a block diagram schematically showing a circuit configuration of the liquid crystal display device according to the second example of modification of the present invention. In FIG. 10, similar parts to those of FIG. 4 are identified by the same reference numerals. In order to simplify the figure, a pixel array unit 2, a gate driver 3, and a data driver 4 of one of a first liquid crystal panel 11 and a second liquid crystal panel 12 are shown in FIG. 10.

As shown in FIG. 10, the liquid crystal display device according to the second example of modification has a frequency detecting circuit 22 for detecting the frequency of an input video signal (driving frequency). Under driving by a driving circuit 8, a driving mode is changed from n-time speed driving to normal driving when the driving frequency is a predetermined frequency or higher.

Thus, in the liquid crystal display device configured to perform the double-speed driving of one or both of the first and second liquid crystal panels 11 and 12, the normal driving, rather than the n-time speed driving, is performed when the driving frequency of the liquid crystal display device, or specifically the frequency of the input video signal, is a predetermined frequency or higher. It is thereby possible to avoid the problem of the insufficient writing capability of the pixel transistor 51 due to change in the driving frequency.

Incidentally, while in the second example of modification, the driving mode is changed from the n-time speed driving to the normal driving when the driving frequency of the liquid crystal display device is a predetermined frequency or higher, the present invention is not limited to the change to the normal driving, and a configuration that changes from the n-time speed driving to (n−1)-time speed driving, (n−2)-time speed driving, . . . , that is, a configuration that decreases (changes) the driving speed may be adopted.

Further, while the foregoing first and second examples of modification have been described by taking as an example a case where amorphous silicon (a-Si) is used as the pixel transistor 51, for example a TFT active element, the present invention is not limited to this, and a configuration can be adopted in which a part or the whole of the active element is formed by polysilicon (p-Si). When this configuration is adopted, the mobility of the TFT differs by about two orders of magnitude, and therefore the writing capability of the pixel transistor 51 does not present a problem.

Third Example of Modification

In each of the foregoing embodiments, the response waveform of the display device as a whole is that of impulse type display, and thus a high degree of effect of improvement on moving image characteristics (response characteristics) is obtained. However, when 120-Hz double-speed driving is performed in a case of 60-Hz normal driving, for example, and a still image is displayed, 60-Hz flicker may be noticeable. This flicker becomes more conspicuous as a gradation difference between a light luminance and a dark luminance of impulse type display is increased, and the flicker tends to be noticeable in still images in particular.

When the number of field divisions within one frame, that is, the value of n is increased, the frequency of the flicker is raised, and thus the flicker can be reduced. Partly because of the above-described problem of the writing capability of the pixel transistor 51, there is a limit to increasing the value of n. A liquid crystal display device according to a third example of modification to be described below is made to reduce the flicker without increasing the number of field divisions within one frame.

Figure 11:
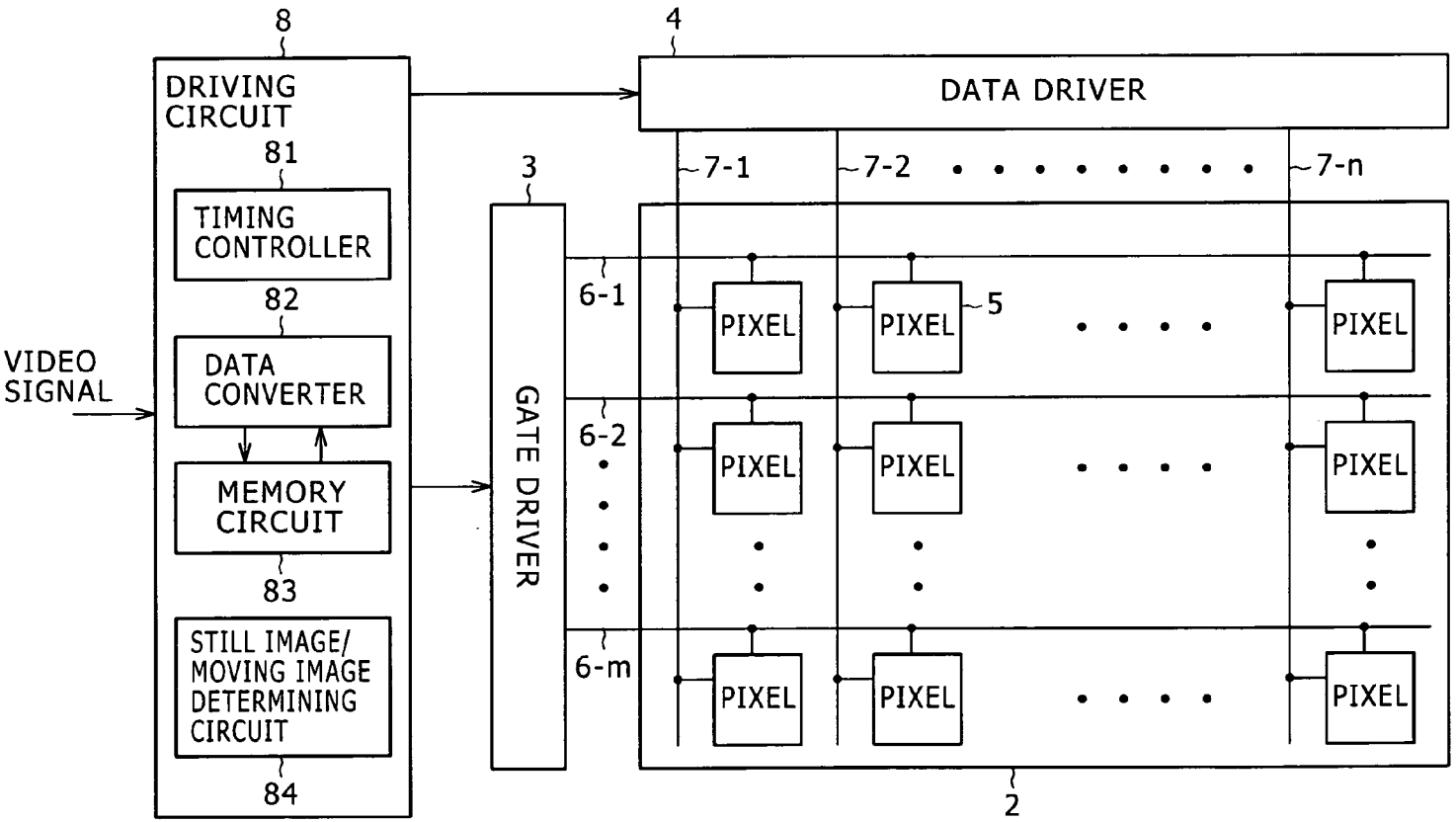
FIG. 11 is a block diagram schematically showing a circuit configuration of a liquid crystal display device according to a third example of modification of the present invention.

FIG. 11 is a block diagram schematically showing a circuit configuration of the liquid crystal display device according to the third example of modification of the present invention. In FIG. 11, similar parts to those of FIG. 4 are identified by the same reference numerals. In order to simplify the figure, a pixel array unit 2, a gate driver 3, and a data driver 4 of one of a first liquid crystal panel 11 and a second liquid crystal panel 12 are shown in FIG. 11.

The liquid crystal display device according to the third example of modification has a still image/moving image determining circuit 84 for determining whether a display image based on a video signal input into a driving circuit 8 is a still image or a moving image. The liquid crystal display device according to the third example of modification uses double-speed driving when displaying a moving image as in each of the foregoing embodiments, and changes a driving mode from n-time speed driving to normal driving when displaying a still image. The still image/moving image determining circuit 84 for example has a frame memory. The still image/moving image determining circuit 84 determines that the display image is a still image when a difference in video signal level between a previous frame and a present frame is a predetermined level or less, and determines that the display image is a moving image when the difference exceeds the predetermined level.

Thus, in the liquid crystal display device configured to perform the double-speed driving of one or both of the first and second liquid crystal panels 11 and 12, the normal driving, rather than the n-time speed driving, is performed when a still image is displayed. It is thereby possible to reduce the flicker without increasing the number of field divisions within one frame when a still image is displayed. Thus, moving image display excelling in moving image characteristics and still image display without flicker can be made compatible with each other.

A problem in this case is a difference in luminance between a moving image and a still image. At a time of display of a moving image, impulse type display is made, and therefore a decrease in luminance is inevitable in principle. At a time of display of a still image, on the other hand, normal driving is performed, and thus there is a small loss of luminance. Accordingly, by adjusting the luminance of a backlight such that the luminance of the backlight is lowered at a time of display of a still image or such that the luminance of the backlight is heightened at a time of display of a moving image, it is possible to eliminate the difference in luminance between the moving image and the still image, and thus make image display at the same luminance in driving for both the moving image and the still image.

This technique of adjusting the backlight luminance is not limited to the third example of modification, and is similarly applicable to the first example of modification in which the operation mode is changed according to the temperature of the display device and the second example of modification in which the operation mode is changed according to the driving frequency.

A liquid crystal display device having a structure in which a plurality of liquid crystal panels are laminated as with the liquid crystal display devices according to the foregoing embodiments and the examples of modification thereof can be used as a display device providing three-dimensional display video or a display device providing display video that differs according to a viewing direction.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display device formed by laminating at least two first and second liquid crystal panels, said liquid crystal panels being each formed by disposing a liquid crystal layer between two transparent substrates arranged so as to be opposed to each other and two-dimensionally arranging pixels in a form of a matrix on one of said two substrates, and disposing a backlight on a side of said first liquid crystal panel, said liquid crystal display device comprising:

first driving means for driving said first liquid crystal panel on a side of said backlight by n-time speed driving in which one frame period is divided into n fields; and second driving means for driving said second liquid crystal panel on a display surface side by normal driving in which one frame period is not divided, wherein the first liquid crystal panel controls an amount of light entering the second liquid crystal panel, and driving of the second liquid crystal panel is set to make display of the first liquid crystal panel and the second liquid crystal panel as a whole an impulse type display in which pixels blink, wherein in a liquid crystal display device that performs double-speed driving of the first liquid crystal panel and normal driving of the second liquid crystal panel, when response waveform of the second liquid crystal panel is a waveform in which a transient change is made from a black gradation to a predetermined gradation in one frame period, and the first liquid crystal panel is driven such that a black gradation voltage is applied in a first field and a white gradation voltage is a applied in a second field, response waveform of the first liquid crystal panel is a sawtooth waveform, and optical waveform of the first liquid crystal panel and the second liquid crystal panel as a whole is a sawtooth waveform, wherein in the liquid crystal display device that performs double-speed driving of the first liquid crystal panel, in a case where two gradations are repeated, polarity of a first field and a second field of a particular frame is made to be positive polarity, and polarity of a first field and a second field of a subsequent frame is made to be negative polarity, and wherein a γ representation of the liquid crystal display device as a whole is equal to a γ representation of the second liquid crystal panel.

2. The liquid crystal display device according to claim 1, wherein said first driving means applies one of a low gradation voltage of black and a low gradation voltage close to the low gradation voltage of black to said first liquid crystal panel in a first field of a frame, and applies one of a high gradation voltage of white and a high gradation voltage close to the high gradation voltage of white to said first liquid crystal panel in a next field and subsequent fields of the frame.

3. The liquid crystal display device according to claim 1, wherein said first driving means applies, to said first liquid crystal panel, different gradation voltages in at least a first field and a last field of a frame, and changes the voltages applied in the first field and the last field according to a display gradation of said second liquid crystal panel.

4. The liquid crystal display device according to claim 1, wherein said first driving means applies a gradation voltage of one of black and white to said first liquid crystal panel in all the n fields when a display gradation of said second liquid crystal panel is one of black and white.

5. The liquid crystal display device according to claim 1, further comprising temperature detecting means for detecting temperature of the liquid crystal display device, wherein said first driving means decreases a driving speed of said first liquid crystal panel when the temperature detected by said temperature detecting means is a predetermined temperature or lower.

6. The liquid crystal display device according to claim 1, further comprising frequency detecting means for detecting driving frequency of the liquid crystal display device, wherein said first driving means decreases a driving speed of said first liquid crystal panel when the frequency detected by said frequency detecting means is a predetermined frequency or higher.

7. The liquid crystal display device according to claim 1, further comprising determining means for determining whether a display image is one of a moving image and a still image, wherein said first driving means performs said normal driving on said first liquid crystal panel when a result of determination by said determining means indicates still image display.

8. The liquid crystal display device according to claim 7, wherein luminance of said backlight is changed between moving image display and still image display that are indicated by a result of determination by said determining means.

9. The liquid crystal display device according to claim 1, wherein a part or a whole of an active element of said pixel is formed by polysilicon.

10. The liquid crystal display device according to claim 1, wherein a liquid crystal mode of said first liquid crystal panel and a liquid crystal mode of said second liquid crystal panel are different from each other.

11. The liquid crystal display device according to claim 1, wherein when one frame period is divided into n fields, an arbitrary field setting is made without equal time division being performed.

12. A driving method of a liquid crystal display device, said liquid crystal display device being formed by laminating at least two first and second liquid crystal panels, said liquid crystal panels being each formed by disposing a liquid crystal layer between two transparent substrates arranged so as to be opposed to each other and two-dimensionally arranging pixels in a form of a matrix on one of said two substrates, and disposing a backlight on a side of said first liquid crystal panel, said driving method comprising the steps of:

driving said first liquid crystal panel on a side of said backlight by n-time speed driving in which one frame period is divided into n fields; and driving said second liquid crystal panel on a display surface side by normal driving in which one frame period is not divided, wherein the first liquid crystal panel controls an amount of light entering the second liquid crystal panel, and driving of the second liquid crystal panel is set to make display of the first liquid crystal panel and the second liquid crystal panel as a whole an impulse type display in which pixels blink, wherein in a liquid crystal display device that performs double-speed driving of the first liquid crystal panel and normal driving of the second liquid crystal panel, when response waveform of the second liquid crystal panel is a waveform in which a transient change is made from a black gradation to a predetermined gradation in one frame period, and the first liquid crystal panel is driven such that a black gradation voltage is applied in a first field and a white gradation voltage is applied in a second field, response waveform of the first liquid crystal panel is a sawtooth waveform, and optical waveform of the first liquid crystal panel and the second liquid crystal panel as a whole is a sawtooth waveform, wherein in the liquid crystal display device that performs double-speed driving of the first liquid crystal panel, in a case where two gradations are repeated, polarity of a first field and a second field of a particular frame is made to be positive polarity, and polarity of a first field and a second field of a subsequent frame is made to be negative polarity, and wherein a γ representation of the liquid crystal display device as a whole is equal to a γ representation of the second liquid crystal panel.

13. A liquid crystal display device formed by laminating at least two first and second liquid crystal panels, said liquid crystal panels being each formed by disposing a liquid crystal layer between two transparent substrates arranged so as to be opposed to each other and two-dimensionally arranging pixels in a form of a matrix on one of said two substrates, and disposing a backlight on a side of said first liquid crystal panel, said liquid crystal display device comprising:

a first driver configured to drive said first liquid crystal panel on a side of said backlight by n-time speed driving in which one frame period is divided into n fields; and a second driver configured to drive said second liquid crystal panel on a display surface side by normal driving in which one frame period is not divided, wherein the first liquid crystal panel controls an amount of light entering the second liquid crystal panel, and driving of the second liquid crystal panel is set to make display of the first liquid crystal panel and the second liquid crystal panel as a whole an impulse type display in which pixels blink, wherein in a liquid crystal display device that performs double-speed driving of the first liquid crystal panel and normal driving of the second liquid crystal panel, when response waveform of the second liquid crystal panel is a waveform in which a transient change is made from a black gradation to a predetermined gradation in one frame period, and the first liquid crystal panel is driven such that a black gradation voltage is applied in a first field and a white gradation voltage is applied in a second field, response waveform of the first liquid crystal panel is a sawtooth waveform, and optical waveform of the first liquid crystal panel and the second liquid crystal panel as a whole is a sawtooth waveform, wherein in the liquid crystal display device that performs double-speed driving of the first liquid crystal panel, in a case where two gradations are repeated, polarity of a first field and a second field of a particular frame is made to be positive polarity, and polarity of a first field and a second field of a subsequent frame is made to be negative polarity, and wherein a γ representation of the liquid crystal display device as a whole is equal to a γ representation of the second liquid crystal panel.

* * * * *